United States Patent [19]

Okamoto et al.

[11] 4,037,471

[45] July 26, 1977

[54] OIL LEVEL DETECTION DEVICE IN ENGINE OIL PAN

[75] Inventors: Yoshinori Okamoto, Kawagoe; Toshio Tsuruoka, Kitaooizumi, both of Japan

[73] Assignee: Honda Giken Kogyo Kabushiki Kaisha, Japan

[21] Appl. No.: 691,192

[22] Filed: May 28, 1976

[30] Foreign Application Priority Data

June 6, 1975 Japan ..... 50-76452[U]

[51] Int. Cl.[2] ..... G01F 23/02

[52] U.S. Cl. ..... 73/324; 15/250.36; 73/118; 73/334

[58] Field of Search ..... 73/324, 334, 118; 15/250.22, 256.52, 250.36; 350/61

[56] References Cited

U.S. PATENT DOCUMENTS

| | | | |
|---|---|---|---|
| 1,068,626 | 7/1913 | Buck | 73/334 |
| 3,089,338 | 5/1963 | Glasgow | 73/324 |

*Primary Examiner*—Richard C. Queisser
*Assistant Examiner*—Denis E. Corr
*Attorney, Agent, or Firm*—Polster and Polster

[57] ABSTRACT

An engine oil level detection device of a construction, wherein an observation window is provided in one part of an oil receptacle or pan, and a wiper to clean the inner surface of the window soiled with the lubricant oil stuck thereonto by splashing is held on the window portion in a manner to be rotatable by finger actions or by a tool.

6 Claims, 3 Drawing Figures

OIL LEVEL DETECTION DEVICE IN ENGINE OIL PAN

BACKGROUND OF THE INVENTION

This invention relates to an engine oil pan, and, more particularly, it is concerned with an improved vessel construction for accommodating engine lubricating oil, which is provided with an observation window for detecting and inspecting the level of engine lubricating oil in the vessel.

As an expedient for detecting a level of the engine oil in motor-cycles, automobiles, and so on, there have been known such one that is constructed with a window for detecting the oil level provided in one side wall portion of the oil pan in place of using the conventional oil level gauging or measuring rod, through which the oil level may be inspected.

However, the engine oil is highly susceptible of being contaminated by blow-by-gas, carbon particles, dusts from the facing of the clutch due to its wear, metal powder due to wear of gears, and so forth. Also, the engine lubricating oil is liable to be oxidized by heat of the combustion engine, and adheres onto the inner surface of the window glass for detecting the level of the lubricant. In particular, in the case of the motor-cycle, the engine lubricating oil is vigorously agitated by the speed changing (or power transmission) gears to be splashed around inside the oil pan and sticks onto the entire inner surface of the window glass for the oil level detection. Such adhesion of the engine oil also occurs due to vibration and considerable inclination of the motor-cycle body during its running. The oil as stuck onto the window glass for the oil level detection assumes a tar-like state due to heat of the engine, while it is kept adhered on to inner surface of the window glass, and rigidly stuck thereto, as the result of which the inside of the oil pan becomes hardly visible to make it inconveniently difficult to detect the level of the engine lubricating oil inside thereof.

SUMMARY OF THE INVENTION

In view of the above-described disadvantage inherent in the known type of the detection device for the engine oil level in the oil pan, it is the fundamental object of the present invention to provide an improved detection device for the engine oil level in the oil pan, wherein the observation window can be made clean depending on necessity.

According to the present invention, generally speaking, there is provided an oil level detection device in an engine oil pan which comprises a pan to accommodate therein engine lubricating oil, an oil level detection window provided at one portion in the engine oil pan, and a wiper to clean the inner surface of said detection window.

The foregoing object, other object, as well as the actual construction and function of the detection device for the level of engine lubricating oil according to the present invention will become more apparent and understandable from the following detailed description of a preferred embodiment thereof, when read in conjunction with the accompanying drawing.

DETAILED DESCRIPTION OF A PREFERRED EMBODIMENT

Figure 1:
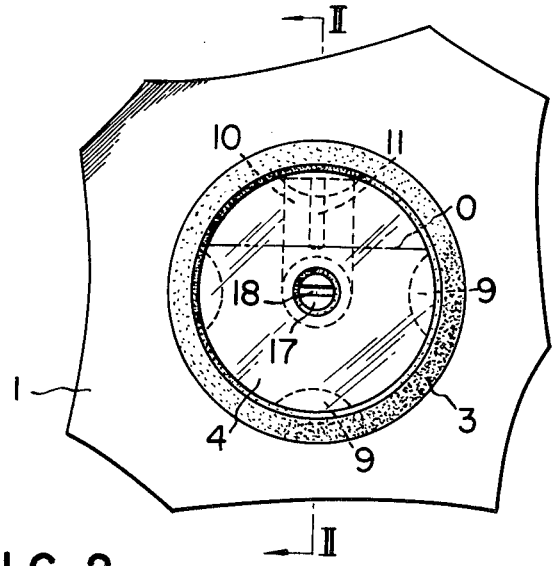
FIG. 1 is a front view of the device for detecting the oil level according to the present invention.
Figure 2:
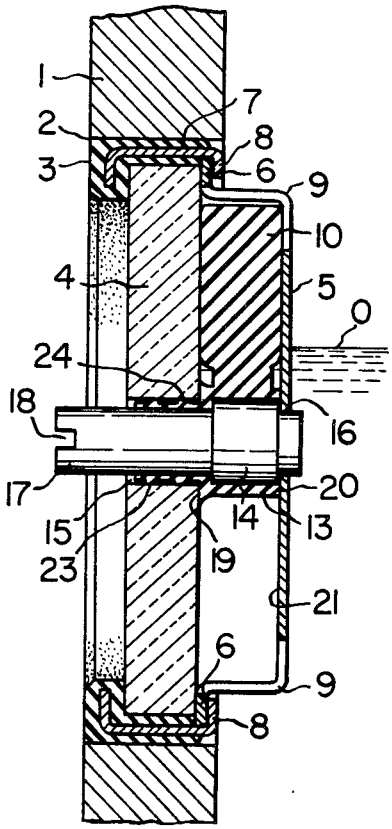
FIG. 2 is an enlarged longitudinal cross-sectional view of the device shown, and taken along the line II—II, in FIG. 1.

Referring now to the drawing, a reference numeral 1 designates a side wall of the engine oil pan, at one portion of which an opening 2 to be an observation window is perforated. Into this perforated opening 2, there is fitted a window glass 4 through an annular rubber packing 3 mounted on the circumference of the perforated window opening 2. Inside the oil pan, there is provided a reflection plate 5 in confrontation to the abovementioned window glass 4 at a certain spaced relationship therebetween. Mounting of the reflection plate 5 is done in such a way that, as shown in the drawing, a flange 6 of the reflection plate 5 is press-fitted to the outer periphery of the window glass 4 at its inner surface and at a bent portion 8 of a reinforcing ring 7 embedded in the abovementioned rubber packing 3. On the outer peripheral part of the abovementioned reflection plate, there are formed four notched portions 9 for oil passage at a certain spaced relationship between them.

Figure 3:
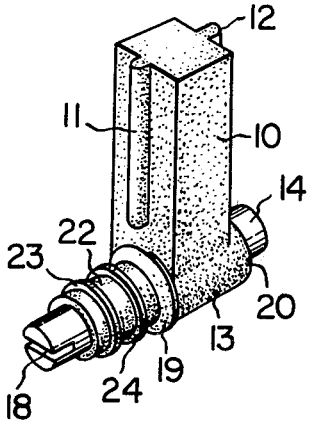
FIG. 3 is a perspective view of a wiper for use in the present invention.

Between the abovementioned window glass 4 and the reflection plate 5, there is interposed a wiper 10 made of rubber material. The wiper 10, as best shown in FIG. 3, possesses wiper blades 11 and 12 on both surfaces facing the window glass 4 and the reflection plate 5, and its base 13 is securely fitted onto a rotational shaft 14. The rotational shaft 14 is rotatably supported on the center through-holes 15 and 16 formed in the window glass 4 and the reflection plate 5, one end of which projects outwardly of the window glass 4. The outwardly projected portion 17 is used as the wiper operating part, on the end surface of which there is formed a recessed groove 18 to engaged with a tool such as a screw driver, and the like. Both end surfaces 19 and 20 of the stem portion 13 of the wiper 10 engaged with the rotational shaft 14 are intimately contacted with the inner surface of the window glass 4 and the reflection surface 21 of the reflection surface 5 so that they may constitute the oil seal. Moreover, the base portion 13 of the wiper 10 fitted on the rotational shaft 14 possesses an extended portion 22 which is outwardly directed. On the outer peripheral surface of this extended portion 22, there are formed annular sealing members 23 and 24, by means of which clearance existing between the through-hole 15 of the window glass 4 and the rotational shaft 14 is maintained in tight seal.

In the afore-described construction of the detection window for the engine oil level, when the projected portion 17 of the rotational shaft 14 is turned by holding the same with fingers, or by a screw driver engaged in the recessed groove 18 at the end surface of the shaft 14, the inner surface of the window glass 4 and the reflection surface 20 of the reflection plate 5 are wiped by the wiper blades 11 and 12, whereby the level of the engine oil O in the oil pan 1 can be inspected through the observation window.

Since the oil level detection window according to the present invention is constructed as such, when the oil level is to be detected, the inner surface of the window glass 4 which has been soiled by oil splashes can be easily wiped off through operation of the wiper 10, whereby the oil level in the oil pan can be accurately and effectively detected.

As a modification to this oil level detection window, it is also possible that the main body of the wiper 10 is made of metal material and is formed integrally with the rotational shaft 14, and the rubber blades is fitted onto both front and rear surfaces of the wiper main body. In this case, the wiper main body may, of course, be separate from the rotational shaft. Further, the rotational shaft 14 of the wiper 10 may be supported on the window glass 4 in a cantilever style. It is also possible that the wiper 10 be constructed in such a manner as to be rotatable by the power of the automobile engine, either constantly or when necessary.

Although the present invention has been described with reference to a preferred embodiment thereof, it should be understood that the embodiment is merely illustrative and not restrictive, and that any change and modification may be made by those skilled in the art within the spirit and scope of the present invention as recited in the appended claims.

What is claimed is:

1. An oil level detection device which comprises, in combination:

a. a receptacle for accommodating therein engine lubricating oil;

b. a window opening formed in one part of the side wall of said oil receptacle, a packing being fitted around the peripheral edge of said window opening to enable a window glass to be fitted therein to constitute an oil level detection window;

c. a reflection plate provided within said oil containing vessel in confrontation to the inner surface of said oil level detection window glass, and securely fitted at the peripheral edge thereof to said packing;

d. wiper means interposed between the inner surface of said window glass and said reflection plate; and e. a rotational shaft for supporting a base portion of said wiper means, said shaft being supported on said oil level detection window and said reflection plate, and having an operating portion projecting outwardly of said detection window, through which the shaft operates said wiper means.

2. The oil level detection device as claimed in claim 1, wherein said outwardly projected operating portion of said rotational shaft is provided at the end surface thereof with an engagement part to be engaged with a manipulative tool.

3. The oil level detection device as claimed in claim 1, wherein said wiper means is made of a metal material and formed integrally with said rotational shaft, rubber blades being attached on both front and rear surfaces thereof.

4. The oil level detection device as claimed in claim 3, wherein said outwardly projected operating portion of said rotational shaft is provided at the end surface thereof with an engagement part to be engaged with a manipulative tool.

5. In an oil level detection device of a type constructed with a receptacle for lubricant, a window opening formed in one part of the side wall of said receptacle fitted with packing means around the peripheral edge thereof to enable a window glass to be mounted therein in an oil sealable manner, a reflection plate provided in said receptacle in confrontation to the inner surface of said window glass, and wiper means placed between the inner surface of said window glass and said reflection plate and on a rotational shaft extending through said window glass and reflection plate, the improvement comprising said reflection plate being securely fitted at the peripheral edge thereof to said packing means, and said wiper means possessing an outwardly extending integral portion at the base part thereof surrounding the rotational shaft for its rigid support thereon and also for tight seal.

6. The oil level detection device as claimed in claim 5, wherein said outwardly projected operating portion of said rotational shaft is provided at the end surface thereof with an engagement part to be engaged with a manipulative tool.

* * * * *